US007648217B2

(12) United States Patent
Cleary et al.

(10) Patent No.: US 7,648,217 B2
(45) Date of Patent: Jan. 19, 2010

(54) PRINTING SYSTEM AND METHOD

(75) Inventors: Michele D. Cleary, Rochester, NY (US); Joseph C. Farbizio, Walworth, NY (US); Hiram E. Jimenez, Webster, NY (US); David L. Rasmussen, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 208 days.

(21) Appl. No.: 11/521,647

(22) Filed: Sep. 15, 2006

(65) Prior Publication Data

US 2008/0068417 A1 Mar. 20, 2008

(51) Int. Cl.
*B41J 29/38* (2006.01)

(52) U.S. Cl. ..... 347/16; 347/101; 347/104

(58) Field of Classification Search ..... 347/16
See application file for complete search history.

(56) References Cited

U.S. PATENT DOCUMENTS

| | | | | |
|---|---|---|---|---|
| 5,003,355 | A * | 3/1991 | Tanzawa | 399/401 |
| 5,221,949 | A * | 6/1993 | Miyamoto | 399/389 |
| 5,619,240 | A * | 4/1997 | Pong et al. | 347/103 |
| 6,501,914 | B2 * | 12/2002 | Yoshikawa | 399/18 |
| 7,029,006 | B2 * | 4/2006 | Izumi et al. | 271/145 |
| 2004/0213590 | A1 * | 10/2004 | Schroath et al. | 399/21 |

* cited by examiner

*Primary Examiner*—Matthew Luu
*Assistant Examiner*—Brian J Goldberg
(74) *Attorney, Agent, or Firm*—Fay Sharpe LLP

(57) ABSTRACT

A printing system includes a media transport pathway, a marking system disposed along the media transport pathway and a sheet media sensor capable of identifying associated sheets of media. An operating module is capable of switching the printing system between a productive condition and a non-productive condition. An advancement module is capable of advancing associated sheets of media along the media transport pathway while the printing system is in the non-productive condition. A method is also included.

15 Claims, 3 Drawing Sheets

PRINTING SYSTEM AND METHOD

BACKGROUND

The present disclosure broadly relates to the art of printing systems and, more particularly, to a printing system capable of identifying residual sheets of media within a transport pathway while in a non-productive condition and in preparation for restoring the printing system to a productive condition as well as a method of operation.

The terms "print", "printing" and "marking" as used herein are to be broadly interpreted to encompass any action or process involving the production or output of sheet media having text, images, graphics and/or other indicia formed thereon by any process, such as inkjet or electrophotographic processes, for example.

The terms "printer" and "printing system" as used here are to be broadly interpreted to encompass any device, apparatus or system that is capable of performing a "printing" action. Examples of such equipment and/or systems include, without limitation, desktop printers, network printers, stand-alone copiers, multi-function printer/copier/facsimile devices, high-speed printing/publishing systems and digital printing presses.

Additionally, such exemplary embodiments of equipment, systems and/or processes can utilize sheet media of any suitable type, kind, material, quality and/or thickness (e.g., recycled paper, plain paper, bond paper, coated paper, card stock, transparencies and/or other media). Furthermore, such exemplary equipment, systems and/or processes can output indicia on such sheet media using any printing or marking substance, such as liquid ink, solid ink, toner and/or colorant, for example, in monochrome (e.g., black) or one or more colors, or any combination thereof.

Further still, the term "productive condition" as used herein is to be broadly interpreted to encompass conditions in which a printing system is presently capable of generating printed output or performing any output generating or related action. For example, a printing system in "productive condition" will normally be powered on, include a usable quantity of consumables (e.g., at least some toner, ink or other marking substance, at least some sheet media, at least some fuser oil), and have an operating system in a ready state (i.e., an active or a sleeping state) that is capable of initiating operation within a short duration, such as less than 10 seconds, for example. The term "non-productive condition" as used herein is to be broadly interpreted to encompass conditions in which a printing system is presently capable of some operation and movement but is presently incapable of generating printed output or performing any output-generating actions. For example, a printing system in a "non-productive condition" will normally be powered on, include a usable quantity of consumables, include an operating system that is active and functional but which is incapable of generating printed output due to an unresolved issue with a component or system. The terms "cycle-up," "cycling-up," "warm-up" and "warming-up" as used herein are to be broadly interpreted to encompass any action or process performed internally by a printing system to return the printing system to a productive condition, such as from an OFF condition (e.g., a no electrical power condition) or a non-productive condition. For example, upon being turned on by a user, a printing system may go through a series of actions, such as energizing components, heating printing elements, checking consumable levels and/or performing various self tests, for example, upon the successful completion of which actions the printing system may be in a productive condition.

Additionally, the subject matter of the present disclosure is particularly well suited for use on and in association with larger printing systems, such as high-speed printing/publishing systems and digital production presses, for example, and will be discussed herein with particular reference thereto. However, the subject matter of the present disclosure is capable of broad use in a wide variety of applications and environments. As such, it is to be distinctly understood that the showings and discussion herein are merely exemplary and are not intended to be limiting.

During normal usage, it is common for printing systems to discontinue operation due to the occurrence of certain events and/or conditions, such as upon exhausting a supply of sheet media, exhausting a supply of fuser oil or upon the initiation of a print quality adjustment, for example. In such situations, printing systems are normally capable of suspending operation in such a manner that the sheets of media actively within the printing system, namely, along the media pathway thereof, are delivered to a suitable sheet media outlet to thereby clear the media pathway. So, upon resolution of the event or condition that caused the discontinuation of operations, the printing system will typically be capable of restoring operation without requesting the performance of any other corrective actions or measures by a user or operator.

In other situations, however, unexpected interruptions in the operation of printing systems can occur. Such unexpected interruptions generally do not permit the printing system to suspend operation in a controlled manner. As a result, the printing system will normally lose track of at least some of the sheets of media within the printing system. One example of such an unexpected interruption in operation is commonly associated with the actual transportation or movement of sheet media along the media pathway. More specifically, one or more sheets of media can become disassociated with the media pathway and impede the movement of other sheets of media therethrough. For example, a portion of a sheet of media may become lodged within the structure of the printing system while the sheet of media is traveling along the media pathway. This can result in the sheet of media becoming drawn outside of the pathway, and often results in the sheet becoming wrinkled, torn or otherwise damaged. However, it will be appreciated that the foregoing is merely one example of a source for an unexpected interruption in operation of a printing system. Accordingly, it will be recognized that such unexpected interruptions can also occur for other reasons, such as due to external power failures, for example.

After an unexpected interruption in operation occurs, regardless of the cause thereof, it is common for printing systems to enter a non-productive condition in which some or all of the sheets of media within the transport pathway are to be removed by a user or operator in preparation (i.e., cycling-up) for the resumption of operation of the printing system. For example, in some printing systems the sheets may be removed from only a small section of the media pathway. Whereas, in other printing systems the entire media pathway of the printing system may be cleared. In situations in which the unexpected interruption was caused by an anomaly in the transport of a sheet of media, any wrinkled, torn or otherwise damaged sheets are also removed.

Many known printing systems include one or more sheet media sensors strategically disposed along the media pathways of the printing system. These sensors are generally used for various operation and performance-related functions of the printing system. Additionally, such sheet media sensors are commonly used to aid in locating sheets of media within the printing system, such as after the occurrence of an unexpected interruption. For example, a printing system will often include a graphical user interface that is capable of displaying a representation of the printing system and/or media pathway. The location of any sheets of media within the media pathway that are observed by the sheet media sensors can be indicated on the graphical interface to aid the user or operator in locating those sheets. Normally, the user or operator will then access the areas of the media path indicated on the graphical interface through suitable access components and clear any sheets that are visible within that area.

Once all visible sheets of media have been removed by the user or operator, the one or more access components of the printing system that have been opened to access the transport pathway are closed by the user or operator. Normally, printing systems include communication devices that are capable of recognizing when an access panel or other component of a printing system is opened or in a condition that is other than a fully closed condition. With all of the access components properly closed, a conventional printing system will then begin to fully cycle up in preparation for normal printing operations.

One difficulty with the foregoing known arrangement and process, is that it is possible for one or more sheets of media remain within the transport pathway even though it is believe to have been fully and properly cleared of sheet media by the user or operator. That is, one or more sheets of media may have become "lost" within the media transport pathway due to the unexpected interruption in operation. For example, the sheet of media may not have been visible to the user or operator during the clearing operation due to the vantage point from which the media pathway was being observed. Alternately, the one or more "lost" sheets of media simply may not have been identified by the one or more sheet media sensors of the printing system.

With reference to this latter possibility, it is well understood that sheet media sensors are strategically positioned within printing systems along the media transport pathways thereof. Due to the length of the media pathways of many printing systems, however, it is possible for some adjacent media sensors to be spaced from one another a distance that is greater than the size of a sheet of media. While such spacing arrangements are typically inconsequential for the performance and operation of the printing system, it is possible for a sheet of media to become "lost" within these areas during an unexpected interruption in operation.

As mentioned above, one disadvantage of known arrangement and process, is that it is possible for one or more residual sheets of media remain within the transport pathway even though the pathway is believe to have been fully and properly cleared. This situation is undesirable because printing systems can often take a significant duration to fully warm-up in preparation for a return to operation. One function that is performed while a printing system is cycling-up (i.e., preparing to return to a productive condition) commonly involves rotating the various drive rollers, nips and other sheet media movers of the printing system. In doing so, however, any residual sheets of media that have not been removed from the media pathway will normally be advanced over a sheet media sensor, which typically causes the printing system to discontinue any ongoing operations (i.e., warm-up activities) and await the clearing of the sheets of media by the user or operator.

To clear the newly-identified (i.e., residual) sheets of media, a user or operator will again displace one or more access panels or other components to access the media pathway and remove the one or more newly-identified sheets of media. The user or operator will then, again, displace the one or more access panels or other components to close or otherwise re-cover the media pathway. With all of the access panels and/or other components properly in place, the printing system can one again prepare to return to operation by initiating the cycle-up or warm-up procedure. In some cases, the foregoing process may be repeated several times before all of the sheets of media have been cleared from the transport pathway.

Though the overall delay may be relatively short for smaller printing systems, it is, nonetheless, desirable to avoid the foregoing interruptions in the warm-up process and the disadvantages attendant thereto. Additionally, the foregoing difficulties can be particularly problematic for very large printing systems, such as high speed/high volume printing systems and digital printing presses, for example, in which the paper paths may be substantially longer, sheet media sensors are often spaced greater distances apart, and cycle up times for the printing system significantly increased.

BRIEF DESCRIPTION

One embodiment of a printing system in accordance with the present disclosure includes a sheet media source capable of outputting associated sheets of media, and a sheet media outlet operatively spaced from the sheet media source. A media transport pathway is in operative communication between the sheet media source and the sheet media outlet. A marking system is operatively disposed along the media transport pathway between the sheet media source and the sheet media outlet. A sheet media sensor is operatively disposed along the media transport pathway and is adapted to identify a location of an associated sheet of media and generate a media sensor signal having a relation thereto. An operating module is capable of switching the printing system between a productive condition and a non-productive condition. An advancement module is capable of advancing an associated sheet of media along the media transport pathway for identification by the sheet media sensor while the printing system is in a non-productive condition.

Another embodiment of a printing system in accordance with the present disclosure includes a housing structure, a media transport pathway extending through at least a portion of the housing structure, and a xerographic marking unit operatively disposed within the housing structure along the media transport pathway. An access component is disposed along the housing structure. The access component is movable between a first position inhibiting access to at least a portion of the media transport pathway and a second position permitting access to at least the portion of the media transport pathway. A conveying device is supported within the housing structure in operative association with the media transport pathway. A media sensor is supported within the housing structure in operative association with the media transport pathway. The media sensor is disposed at a first distance from the conveying device and is operative to generate a media sensor signal indicative of one of the presence and absence of an associated sheet of media. A control system is in communication with at least the marking unit, the conveying device and the media sensor. The control system is operative to place the printing system in a non-productive condition upon the occurrence of an unexpected event. The control system is also operative to determine that the access component has been moved from the second position to the first position while the printing system is in the non-productive condition. The control system is further operative to advance an associated sheet of media at least approximately the first distance using the conveying device while the printing system is in the non-productive condition and to determine whether the media sensor is sensing an associated sheet of media while the printing system is in the non-productive condition. If the media sensor senses an associated sheet of media, the control system is operative to communicate to an associated user that the associated sheet of media is within the media transport pathway, and if the media sensor does not sense an associated sheet of media, the control system is operative to initiate returning the printing system to a productive condition.

One example of a method in accordance with the present disclosure of operating a printing system in a non-productive condition is provided that includes providing a printing system. The printing system including a housing structure, a media transport pathway extending through at least a portion of the housing structure, and a marking unit operatively disposed within the housing structure along the media transport pathway. The printing system also includes an access component disposed along the housing structure, a conveying device supported within the housing structure in operative association with the media transport pathway, and a media sensor supported within the housing structure in operative association with the media transport pathway. The access component being movable between a first position inhibiting access to at least a portion of the media transport pathway and a second position permitting access to at least a portion of the media transport pathway. The media sensor disposed at a first distance from the conveying device and operative to generate a media sensor signal indicative of one of the presence and absence of an associated sheet of media. The method also includes determining that the access component has been moved from the second position to the first position. The method further includes moving the conveying device an amount sufficient to advance a sheet of media at least approximately the first distance. The method also includes determining whether a sheet of media is disposed within the media transport pathway using the media sensor. If a sheet of media is within the media transport pathway, the method includes communicating to a user that the sheet of media is within the media transport pathway, and if a sheet of media is not within the media transport pathway, the method includes initiating the cycling up of the printing system.

DETAILED DESCRIPTION

Figure 1:
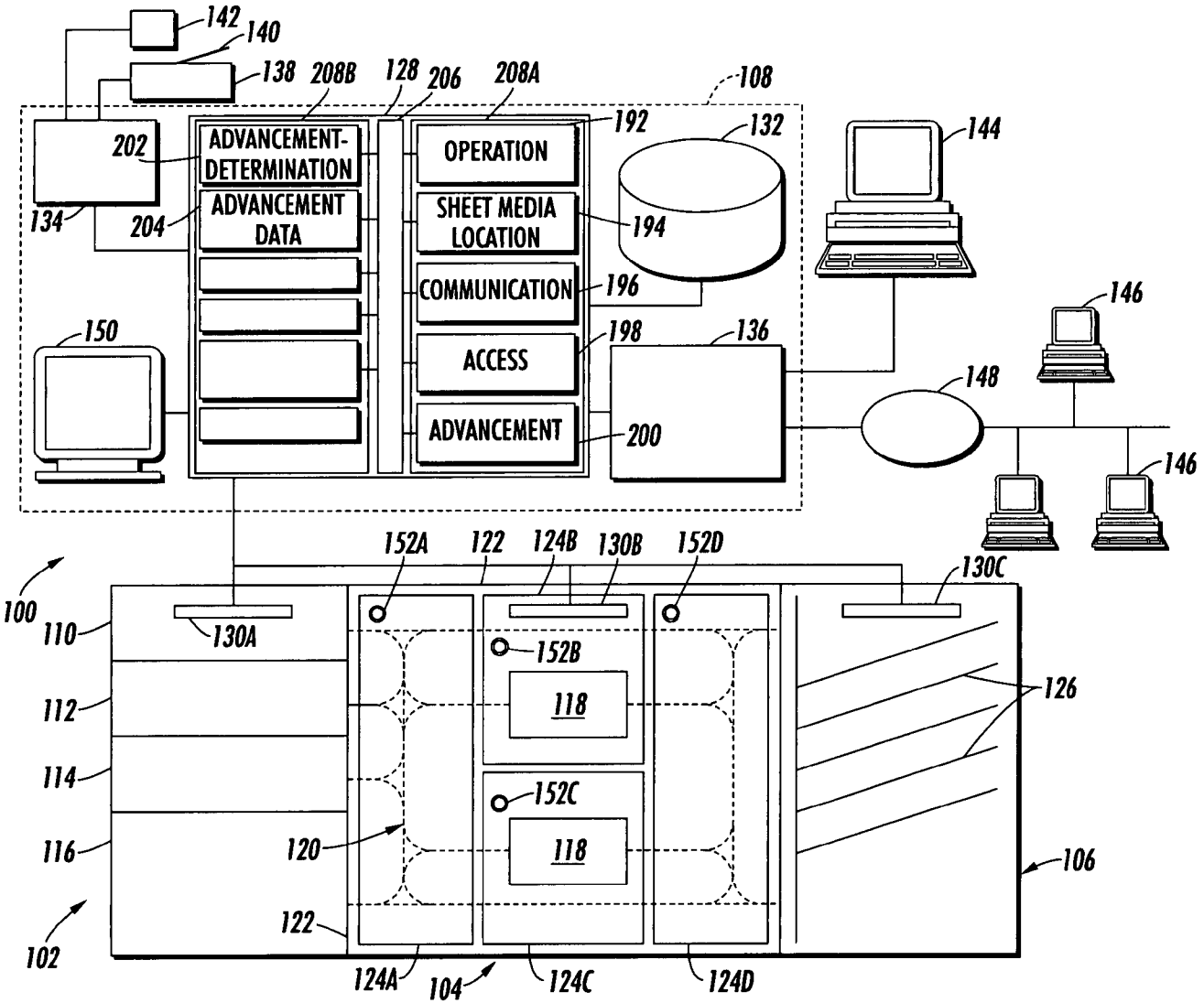
FIG. 1 is a schematic representation of one embodiment of a printing system capable of identifying residual sheets of media within a transport pathway while in a non-productive condition.

Turning now to the drawings wherein the showings are for the purpose of illustrating exemplary embodiments, and not for limiting the same, FIG. 1 schematically illustrates a printing system 100 that includes a sheet media source 102, a marking system 104 in operative communication with the sheet media source, and a sheet media outlet 106 in operative communication with the marking system. Printing system 100 also includes a control system 108 in communication with one or more of the sheet media source, the marking system and/or the sheet media outlet for selective operation thereof. In the embodiment shown in FIG. 1, control system 108 is in communication with each of these systems. It is to be distinctly understood, however, that aspects of the present disclosure are applicable to a wide variety of types and kinds of printing systems, and that printing system 100 is merely exemplary of one suitable printing system.

Sheet media source 102 is shown in FIG. 1 as including multiple media supply trays 110, 112, 114 and 116, which are suitable for storing bulk quantities of sheet media. Media source 102 can also optionally include a bypass supply tray (not shown) that is capable of handling smaller quantities of sheet media. It will be appreciated that the supply trays are operative to introduce individual sheets of media to a suitable sheet feeding system or mechanism for dispensing the individual sheets. Additionally, it will be appreciated that media supply trays 110-116 are capable of receiving and supporting quantities of sheet media of any one of a variety of different sizes (e.g., letter, legal, A4) and/or orientations (e.g., short-edge first, long-edge first).

Figure 2:
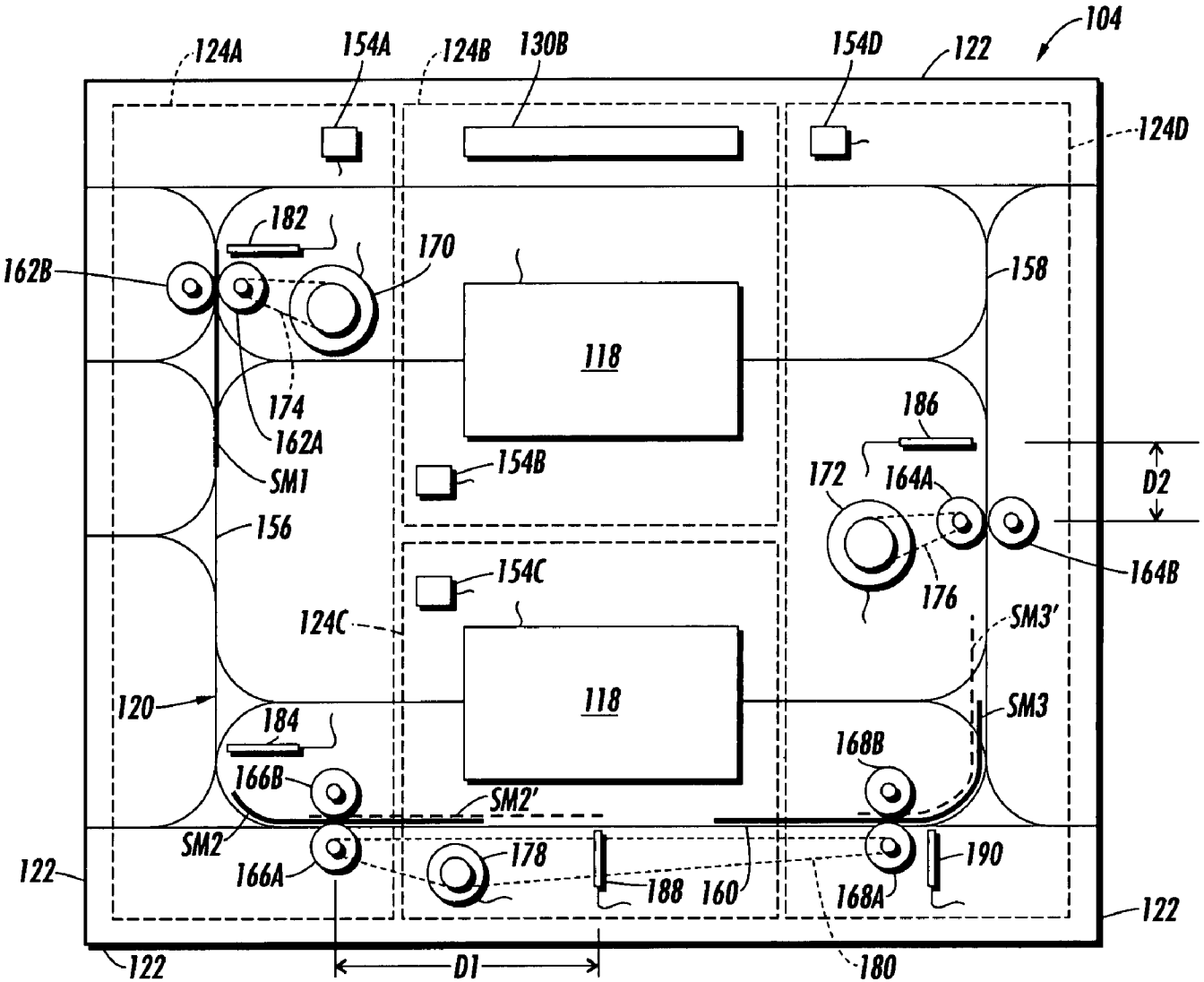
FIG. 2 is a schematic representation of the marking system of the printing system in FIG. 1 showing sheet media being advanced into identifying positions.

As can be seen in FIGS. 1 and 2, marking system 104 can include one or more printing engines 118 in communication with media source 102 through a media transport pathway 120. It will be appreciated that the one or more printing engines can be of any suitable type or kind, and that such one or more printing engines will operate in accordance with known marking principles, such as ink jet marking or electrophotographic marking, for example. Marking system 104 includes a structural framework or housing structure 122 that is capable of supporting the one or more printing engines. Additionally, media transport pathway 120 extends through at least a portion of the structural framework to operatively communicate with the one or more printing engines. Marking system 104 also includes one or more components that are capable of being displaced by a user or operator to access at least a portion of the media transport pathway. In the embodiment in FIGS. 1 and 2, marking system 104 is shown as including four walls or access panels 124A-124D that outwardly cover portions of housing 122 as well as different portions of media transport pathway 120. It will be appreciated, however, that any other suitable arrangement of moveable walls, access panels and/or other access components can alternately, or additionally, be used.

Returning, again, to FIG. 1, sheet media outlet 106 includes one or more output trays 126, and is in communication with the one or more printing engines of marking system 104 via media pathway 120. The sheet media outlet can be of any suitable type or kind, and can optionally be capable of performing one or more finishing operations of any type or kind. For example, sheet media outlet 106 could be operative to stack, collate, staple, hole punch, offset, bind, fold, insert separator sheets, and/or any combination of these or any other finishing operations.

As will be recognized by one of skill in the art, sheet media is fed from media source 102 to one or more printing engines 118 along media pathway 120. Once output by the printing engine or engines, the marked sheet media is delivered to the sheet media outlet and can simply be stacked, or one or more optional finishing operations can be performed.

In the exemplary embodiment shown in FIG. 1, control system 108 includes a controller 128 in communication with sheet media source 102, marking system 104 and sheet media outlet 106, each in a suitable manner. As one example, media source 102, marking system 104 and sheet media output 106 could be under direct supervision and control by controller 128. Alternately, control system 108 could optionally include one or more electronic control units (ECUs) 130A-C that are respectively associated with sheet media source 102, marking system 104 and sheet media outlet 106. Such one or more ECUs, if provided, can be in communication with controller 128 and at least partially supervise and/or control the respective components and/or systems with which the ECU or ECUs are associated.

Control system 108 can optionally include a data storage device 132, such as a non-volatile memory or hard drive, for example, suitable for storing print jobs, settings, attributes and any other data, values, text, graphics, information and/or content. The data storage device is shown in FIG. 1 as being in direct communication with controller 128, though it will be appreciated that any other suitable arrangement could alternately be used. Additionally, control system 108 can optionally include an input interface 134 and/or a communication interface 136, both of which are shown in communication with controller 128. Either or both of input interface 134 and communication interface 136 can be used to generate, receive, input or otherwise provide print jobs to the printing system. For example, input interface 134 can be in communication with an optional raster output scanning system 138 suitable for scanning paper documents and transmitting rasterized images of the scanned documents in the form of image data to the controller or another system or component. Scanning system 138 can optionally include an automatic document feeding device 140 or other suitable arrangement for inputting sheet media. As another example, input interface 134 could be in communication with an optional memory device reader 142 adapted to retrieve document files, image files or other data or information from portable memory devices, such as memory cards, for example, and transmit such files, data or information to controller 128 or another system or component. As a further example, a print job could optionally be transferred or otherwise sent to the printing system through communication interface 136, such as from a standalone computer 144 and/or from a computer workstation or terminal 146, for example, such as through a suitable computer network 148, for example. A print job, however transmitted or received, can be directly communicated to controller 128 for processing or the print job can be stored in a suitable manner, such as within data storage device 132, for example, until recalled for printing.

One or more user interface devices, such as a display, keyboard, pointing device, indicator lamp, associated computing device (e.g., a remotely connected or networked computer) or other input or output device, is provided on printing system 100 and is in communication with controller 128. In one preferred embodiment, a display 150 is provided that outputs graphical programming windows for communication of text, graphics, data, values and/or information to a user or operator. Additionally, the user interface is adapted for user input of text, graphics, data, values and/or information, such as from the keyboard (not shown), pointing device (not shown) or, in one preferred embodiment, touch-screen input on display 150, for example. It will be appreciated, however, that the foregoing user interface arrangement is merely exemplary and that text, graphics, data, values and/or information can be inputted and outputted in any suitable manner.

Furthermore, control system 108 can optionally include one or more indicator devices for communicating with the user or operator as will be described in detail hereinafter. In the embodiment shown in FIG. 1, indicator lamps 152A-152D are respectively provided on access panels 124A-124D and can be in communication with controller 128 directly or through ECU 130B. Additionally, as is shown in FIG. 2, access panel sensors 154A-154D or other suitable devices are operatively associated with access panels 124A-124D, respectively. The access panel sensors are capable of generating signals indicative of an open panel condition and/or a closed panel condition.

In the exemplary embodiment shown in FIGS. 1 and 2, media transport pathway 120 includes multiple horizontal and vertical path portions, such as for communicating with sheet media source 102 and sheet media outlet 106 as well as with printing engines 118. For purposes of clarity and ease of illustration, only a few of the path portions will be specifically referred to herein, though it will be recognized that any suitable media transport pathway and/or pathway portions can be used. As identified in FIG. 2, media transport pathway 120 includes a first vertical path portion 156, a second vertical path portion 158, and a horizontal path portion 160. A set of media drive rollers 162A-162B are disposed along first vertical path portion 156 and are capable of moving sheets of media, such as associated sheet of media SM1, therealong. Another set of media drive rollers 164A-164B are disposed along second vertical path portion 158 and are capable of moving sheets of media (not shown) therealong. Additionally, sets of media drive rollers 166A-166B and 168A-168B are disposed along horizontal path portion 160 and are also capable of moving sheets of media, such as associated sheets of media SM2 and SM3, for example, therealong. It will be appreciated that the sets of media drive rollers can be rotated in any suitable manner and using any suitable drive mechanism. In the exemplary embodiment shown, media drive rollers 162A and 164A are operatively connected to motors 170 and 172, respectively, through suitable transmissions, such as belts 174 and 176, for example. Additionally, media drive rollers 166A and 168A are operatively connected to a common motor 178 through a suitable transmission, such as a belt 180, for example.

Printing systems commonly include one or more sheet media sensors capable of generating a signal indicative of the presence or absence of a sheet of media within a predetermined proximity of the sensor. For purposes of clarity and ease of illustration, only a few of the sheet media sensors are shown and specifically referred to herein. It is to be understood, however, that any suitable number and/or arrangement of sheet media sensors can be used.

As identified in FIG. 2, sheet media sensors 182 and 184 are disposed along first vertical path portion 156. Sheet media sensor 182 is positioned adjacent drive roller set 162, and sheet media sensor 184 is supported adjacent drive roller set 166. Another sheet media sensor 186 is disposed along second vertical path portion 158 adjacent drive roller set 164. Additionally, a sheet media sensor 188 is disposed along horizontal path portion 160 between drive roller sets 166 and 168, and a sheet media sensor 190 is disposed adjacent drive roller set 168 opposite sheet media sensor 188. As will be discussed in additional detail hereinafter, it will be recognized that sheet media sensor 188 is spaced a distance D1 from drive roller set 166, whereas sheet media sensor 186 is spaced a distance D2 from drive roller set 164.

It will be recognized that the various components and/or systems discussed above, such as access panel sensors, motors and sheet media sensors, for example, can be in communication with control system 108 in any suitable manner, such as by direct communication with controller 128 or through ECU 130B, for example.

Control system 108 includes an operation module 192 capable of discontinuing operation of the printing system (i.e., entering a non-productive condition), such as upon the occurrence of an unexpected event, for example, and capable of returning the printing system to operation (i.e., entering a productive condition), such as upon the restoration of the printing system to an operative condition after an unexpected interruption in operation, for example. Typically, the operation module will be capable of initiating a cycle-up or warm-up procedure or routine in preparation for entering a productive condition of the printing system. Control system 108 also includes a sheet media location module 194 capable of operation at least while the printing system is in a non-productive condition, and is operative to determine the location of sheets of media within the printing system, such as along media pathway 120, for example. As one example, sheet media location module 194 could receive signals (or data or other communications representative of signals) from one or more sheet media sensors, such as sensors 182-190, for example, and determine the presence or absence of sheets of media at the sheet media sensor locations based at least partially thereon.

The control system additionally includes a communication module 196 that is capable of operation, at least while the printing system is in a non-productive condition, and is operative to generate signals corresponding to the location of one or more sheets of media within the printing system, such as along the media transport pathway, for example, and communicating such locations to a user or operator. As an example, communication module 196 could receive data, communications and/or other signals from module 194 and generate a graphical representation on a user interface device, such as display 150, for example, illustrating the locations of the identified sheets of media within the printing system. Control system 108 further includes an access module 198 capable of, at least while the printing system is in a non-productive condition, and operative to determine if one or more walls, access panels (e.g., access panels 124A-124D) and/or other access components are in an open condition, in which media transport pathway 120 is accessible, or a closed condition, in which the media transport pathway is inaccessible. For example, access module 198 could receive signals from one or more of access panel sensors 154 (or data or other communications representative of signals from one or more of the access panel sensors) and determine the open or closed condition of the associated access panels or other components of the printing system based at least partially thereon. Data, signals and/or communications corresponding to the open or closed condition of the associated access panels or other components can then be communicated to another system or module, or retained for later processing and/or determinations. For example, the access module can then generate or otherwise output an access complete signal or communication indicating that the access to the media transport pathway by the user or operator is complete.

Control system 108 also includes an advancement module 200 that is capable of, at least while the printing system is in a non-productive condition, and operative to advance any sheets of media within the transport pathway of the printing system, such as is shown in FIG. 2 in which associated sheets of media SM2 and SM3 are advanced to locations indicated by SM2' and SM3'. It will be appreciated that advancement module 200 can advance any such sheets of media in response to any suitable signal and/or communication, such as may be generated upon the occurrence of an action by a user or operator or an event or condition related to the recovery from an unexpected interruption, for example. As a more specific example, and without operating as a limitation, advancement module 200 could be operative to affect the movement, rotation or other displacement of one or more sets of drive rollers, nips and/or other sheet media conveying devices or components, such as one or more of drive roller sets 162, 164, 166 and/or 168, for example, such as after clearance of a portion of the media transport pathway by a user or operator, for example.

In one embodiment of advancement module 200, each of the drive rollers, nips and other sheet media conveying devices could be rotated or otherwise displaced, such as after at least a portion of the media transport pathway has been cleared by a user or operator, for example. In this embodiment, each of the drive rollers, nips and/or other conveying devices could be moved a uniform amount, such as an amount sufficient to advance any sheet of media that is operatively associated with a conveying device to the next adjacent sheet media sensor.

In another embodiment of advancement module 200, one or more of the drive rollers, nips and/or other sheet media conveying devices could be selectively rotated or moved. As one example, any drive rollers, nips and/or other sheet media conveying devices disposed along a portion of the media pathway that has been accessed by a user or operator could be rotated or otherwise displaced, such as upon the recognition by the control system that any moveable walls, access panels and/or other components used to access the portion of the media pathway have been closed or otherwise replaced. Additionally, any drive rollers, nips and/or other conveying devices or components that are rotated or moved could be displaced in different amounts, such as may be desirable due to the variation in distances between a given conveying device and the next adjacent sheet media sensor.

Control system 108 can also optionally include an advancement-determination module 202 that is capable of, at least while the printing system is in a non-productive condition, and operative to calculate or otherwise determine a suitable magnitude or amount (e.g., distance, rotational angle, duration of rotation) of a sheet media advancement, such as may be based on the physical structure and/or component performance capabilities of the printing system, for example. That is, advancement-determination module 202 can be capable of calculating or otherwise determining the approximate number of rotations that a drive roller should be moved to advance any sheet of media that might potentially be associated therewith to at least reach the next adjacent sheet media sensor. For example, such determinations could be based upon specific preprogrammed algorithms within module 202 that are associated with certain conveying devices and/or sheet media sensors. As another example, such determinations could be based upon general preprogrammed algorithms within module 202 that determine the desired amount or magnitude of sheet advancement based on data, values, settings and/or other information specific to the conveying devices and/or sheet media sensors. As such, control system 108 can also optionally include one or more data or information modules. For example, an advancement data module 204 can retain data, values, settings and/or other information specific to one or more of the drive roller sets, nips and/or other conveying device or components of the printing system.

In the embodiment shown in FIG. 1, control system 108 includes a processing device, which can be of any suitable type, kind and/or configuration, such as a microprocessor, for example, for processing data, executing software routines/programs, and other functions relating to the performance and/or operation of printing system 100. Additionally, control system 108 includes a storage device or memory, which can be of any suitable type, kind and/or configuration that can be used to store data, values, settings, parameters, inputs, software, algorithms, routines, programs and/or other information or content for any associated use or function, such as use in association with the performance and/or operation of the printing system or communication with a user or operator, for example.

In the embodiment shown in FIG. 1, controller 128 includes a microprocessor 206 and a storage device or memory 208, which is represented in FIG. 1 by boxes 208A and 208B. In the embodiment shown, modules 192-204 are implemented as software stored within memory 208A and 208B. Thus, microprocessor 204 can access memory stores 208A and 208B to retrieve and execute any one or more software modules, such as modules 192-204, for example. It will be appreciated that such software routines can be individually executable routines or portions of a software program, such as an operating system, for example. Additionally, it will be appreciated that the control system, including any controller, processing device and/or memory, can take any suitable form, configuration and/or arrangement, and that the embodiments shown and described herein are merely exemplary. Furthermore, it is to be understood, however, that the modules described above in detail can be implemented in any suitable manner, including, without limitation, software implementations, hardware implementations or any combination thereof.

Figure 3:
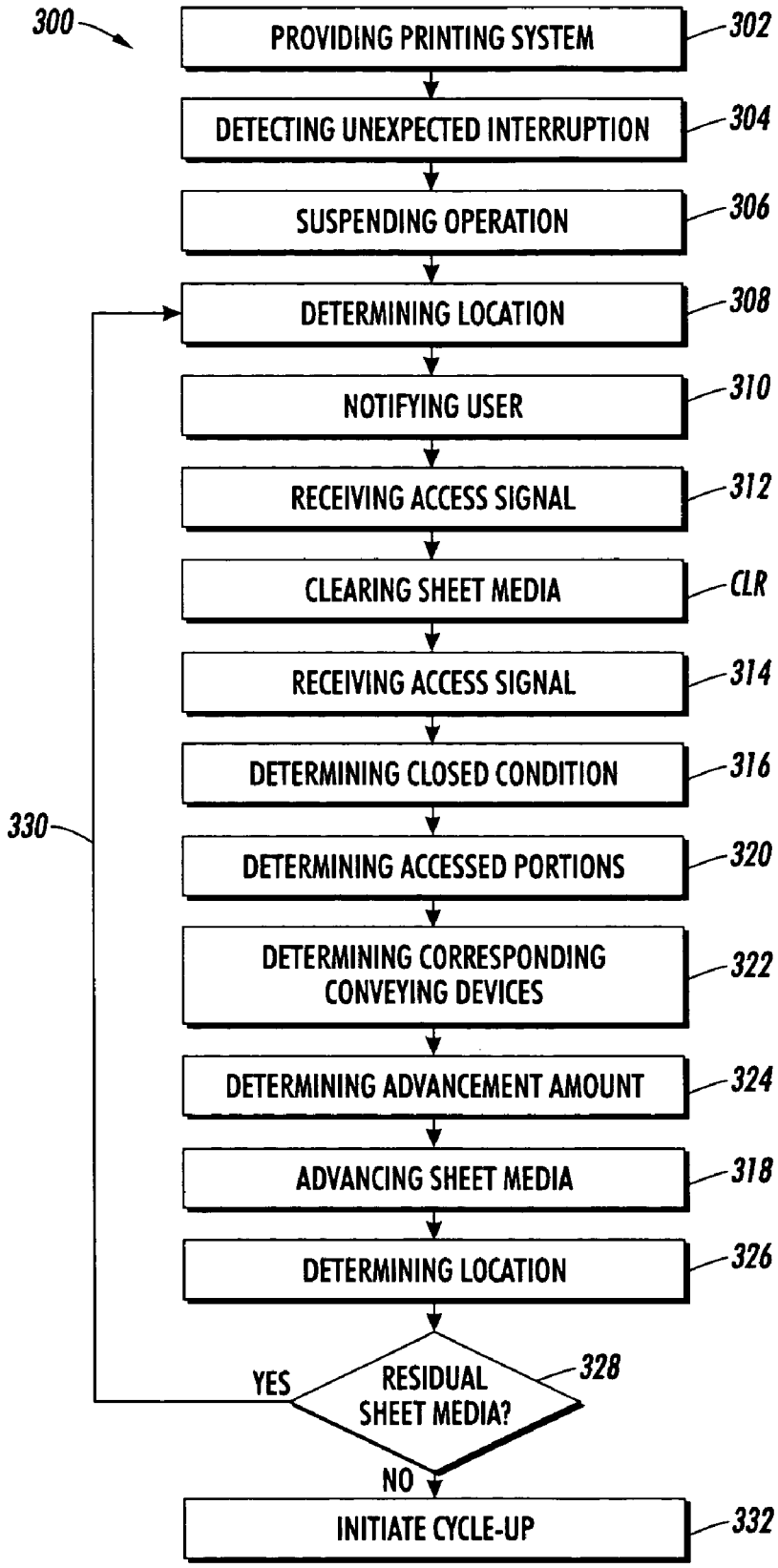
FIG. 3 is a flowchart illustrating one exemplary method of operating a printing system to identify residual sheets of media while in a non-productive condition.

One example of a method 300 of operating a printing system, such as printing system 100, for example, is shown in FIG. 3 and includes providing a printing system, such as printing system 100, for example, which is capable of identifying residual sheets of media within the printing system while in a non-productive condition, as indicated by item number 302. Method 300 also includes detecting or otherwise recognizing the occurrence of a condition or event resulting in an unexpected interruption, as indicated by item number 304, and suspending or otherwise discontinuing operation of the printing system, as indicated by item number 306. Upon the discontinuation of operation as a result of an unexpected interruption, it will be recognized that the printing system will be in a non-productive condition in which the printing system will be capable of performing one or more of the remaining actions of method 300.

Method 300 also includes determining a location of a sheet of media, as indicated by item number 308, and notifying a user or operator of the location, as indicated by item number 310. It will be appreciated that, in many situations, the user or operator will be notified of the location of two or more sheets of media. Once notified of the location or locations of the sheet or sheets of media within the printing system, the user or operator will undertake the removal or clearance of those known sheets of media from the printing system as well as any others that might be visible to the user or operator. To do so, the user or operator will access one or more portions of the printing system, such as by opening an access panel or other component. Thus, method 300 includes receiving an access signal indicative of an open condition of an access component, as indicated by item number 312.

The user or operator can then remove or clear the sheet media, as indicated by box CLR in FIG. 3, and close the one or more access panels or other access components that were opened. Thus, method 300 can also optionally include receiving another access signal indicating the closed condition of the access component, as indicated by item number 314. It will be appreciated that the access signals can be of any suitable type or kind. For example, the "first" signal could be the presence of a normally absent signal and the "second" signal could be the recognition that the normally absent signal is once again absent. Additionally, it will be appreciated that two or more access panels may be utilized to remove all of the known sheets of media. As such, method 300 can optionally include determining that all access components are properly secured in a closed condition, as indicated by item number 316.

Method 300 also includes displacing one or more of the conveying devices of the printing system to advance any residual sheets of media a sufficient distance to reach a sheet media sensor for identification, as indicated by item number 318. In one example of method 300, all of the conveying devices of the printing system could all be rotated or otherwise moved the same amount. Alternatively, method 300 can optionally include determining which portions of the printing system were accessed, as indicated by item number 320, such as by determining which access components were opened, for example. In such case, method 300 can also optionally include determining which one or more of the conveying devices are associated with the accessed portion of the printing system, as indicated by item number 322, such as which conveying devices or conveying device motors are concealed by the opened access components. Method 300 could then advance, in item number 318, the conveying devices identified in item number 322.

As another or additional alternative, method 300 can optionally include displacing different conveying devices of the printing system different amounts, such as moving drive roller set 166 a distance D1 and drive roller set 164 a distance D2 as shown in FIG. 2, for example. Such different amounts can, in one example, be preprogrammed or otherwise established within the printing system. Alternatively, method 300 can include determining an advancement amount, as indicated in item number 324, such as a distance, an angle of rotation or a duration of movement, for example. Method 300 could then advance, in item number 318, one or more of the conveying devices the determined advancement amount. It will be appreciated that different advancement amounts may be determined for different conveying devices. It will be further appreciated that the determination of advancement amount, in item number 324, can be based upon any suitable criteria, data, values and/or information, such as relative sheet media sensor position and/or the size/orientation of the sheet media known to be in use within the printing system, for example.

Having advanced any residual sheets of media, as indicated in item number 318, and regardless of which specific manner such advancements are made, method 300 includes determining the location of any residual sheets of media, as indicated by item number 326. A determination in item number 326 can be made in any suitable manner, such as by receiving a signal or communication from a sheet media sensor indicating the presence of a recovered sheet of media at the location thereof, for example. Method 300 then reaches a decision box 328 at which an inquiry is made as to whether any residual sheets are present in the printing system. If a YES determination is made, method 300 returns to item number 308, as indicated by arrow 330, to determine the location of the residual sheets and proceeds to notify the user or operator of such one or more locations in item number 310. One or more of the subsequent actions (e.g., the actions associated with item numbers 312-326) can thereafter be repeated. If a NO determination is made at decision box 328, method 300 proceeds to initiate a cycle-up routine or otherwise prepare for returning the printing system to a productive condition, as indicated in item number 332.

A more specific example of a method of operation of printing system in a non-productive condition, such as printing system 100 as shown in FIG. 2, for example, includes sheet of media SM1 disposed along first vertical pathway 156 in operative association with drive roller set 162. Sheet of media SM1 is positioned adjacent sheet media sensor 182 such that the sheet of media will be sensed or otherwise identified thereby. Additionally, sheet of media SM3 is disposed along horizontal pathway portion 160 and second vertical pathway portion 158. Sheet of media SM3 is operatively associated with drive roller set 168 and is disposed adjacent sheet media sensor 190 such that the sheet of media can be sensed or otherwise detected thereby. As such, the printing system would identify two sheets of media, namely, sheets of media SM1 and SM3, for removal by a user or operator. Thus, the printing system will notify the user or operator of the presence of sheet of media SM1 at the location of sheet media sensor 182 and sheet of media SM3 at the location of sheet media sensor 190, and the user or operator will access those portions of the media transport pathway by way of suitable access components, such as access panels 124A, 124C and/or 124D, for example.

Having determined that one or more of the access panels has been opened and then closed or otherwise properly secured, the printing system is then operative to move or otherwise displace one or more of the conveying devices to potentially advance any residual sheets of media within the printing system. It will be recognized that sheet of media SM2 is spaced from sheet media sensor 184 and sheet media sensor 188. As such, sheet of media SM2 is a residual sheet of media that is not identified as being located within the printing system. However, having determined that one or more of the access panels or other access components of the printing system have been opened and then closed, conveying devices, such as the conveying devices associated with those one or more access components, for example, are then moved or otherwise displaced to advance any potential residual sheets within the printing system. As such, having recognized that access panel 124A has been opened and closed, the conveying devices disposed therebehind, such as drive roller set 166, for example, are moved or otherwise displaced. Such an action will advance sheet of media SM2 a sufficient distance, such as distance D1, for example, so that the sheet of media is in the position identified in FIG. 2 by reference characters SM2' adjacent sheet media sensor 188 and can be sensed or otherwise identified thereby. Having identified the sheet of media at the location indicated by reference characters SM2', the user or operator can be notified of the presence of the sheet within the printing system and can attend to the removal thereof. Once all residual sheets of media have been identified and removed, the printing system proceeds to warm up and enter a productive configuration.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of operating a printing system, said method comprising:

a) providing a printing system that is capable of switching between a productive condition in which said printing system is capable of generating printed sheets of media and a non-productive condition in which said printing system is incapable of generating printed sheets of media, said printing system including:

a housing structure;

a media transport pathway extending through at least a portion of said housing structure;

a marking unit operatively disposed within said housing structure along said media transport pathway;

an access component disposed along said housing structure, said access component moveable between a first position inhibiting access to at least a portion of said media transport pathway and a second position permitting access to at least said portion of said media transport pathway;

first and second conveying devices supported within said housing structure in operative association with said media transport pathway; and first and second media sensors supported within said housing structure in operative association with said media transport pathway, said first and second media sensors operative to generate a media sensor signal indicative of one of the presence and absence of an associated sheet of media, said first media sensor disposed a first distance from said first conveying device and said second media sensor disposed a second distance from said second conveying device with said first distance being different than said second distance;

b) placing said printing system in said non-productive condition upon the occurrence of an unexpected event;

c) determining that said access component has been moved from said second position to said first position;

d) determining an amount for said first and second conveying devices to be operated to advance a sheet of media one of said first and second distances;

e) operating at least one of said first and second conveying devices said determining amount to thereby advance a sheet of media one of said first and second distances while said printing system is in said non-productive condition;

f) determining whether a sheet of media is disposed within said media transport pathway using at least one of said first and second media sensors while said printing system is in said non-productive condition; and, g) if a sheet of media is determined to be within said media transport pathway, communicating to a user that the sheet of sheet of media is within said media transport pathway; or, h) if a sheet of media is determined to not be within said media transport pathway, initiating an action to return said printing system to said productive condition.

2. A method according to claim 1 further comprising determining a location of a sheet of media based at least in part on said media sensor signal from at least one of said first and second media sensors and communicating said location to a user.

3. A method according to claim 1 further comprising repeating actions c)-f) until determining whether a sheet of media is disposed in said media transport pathway in f) includes determining that a sheet of media is not within said media transport pathway.

4. A method according to claim 1, wherein operating at least one said first and second conveying devices in e) includes operating both of said first and second conveying devices said determined amount.

5. A method according to claim 4, wherein said first and second conveying devices connected to one another for synchronous operation, and operating at least one of said first and second conveying devices in e) includes synchronously operating both of said first and second conveying devices said determined amount.

6. A method according to claim 1, wherein said first and second conveying devices included one of a rotatable drive roller or a rotatable nip, and operating at least one of said first and second conveying devices in e) includes rotating of said ones of a rotatable drive roller or said rotatable nip.

7. A method according to claim 6, wherein rotating of said ones of a rotatable drive roller or said rotatable nip includes rotating of said ones of a rotatable drive roller or said rotatable nip through an angle of rotation sufficient to advance the associated sheet of media at least approximately said determined one of said first and second amounts.

8. A method according to claim 7, further comprising determining an angle of rotation sufficient to advance the associated sheet of media at least approximately said determined one of said first and second amounts.

9. A printing system comprising:

a housing structure;

a media transport pathway extending through at least a portion of said housing structure;

a xerographic marking unit operatively disposed within said housing structure along said media transport pathway;

an access component disposed along said housing structure, said access component moveable between a first position inhibiting access to at least a portion of said media transport pathway and a second position permitting access to at least said portion of said media transport pathway;

first and second conveying devices supported within said housing structure in operative association with said media transport pathway and synchronously operable with one another;

first and second media sensors supported within said housing structure in operative association with said media transport pathway, said first and second media sensors operative to generate a media sensor signal indicative of one of the presence and absence of an associated sheet of media, said first media sensor disposed a first distance from said first conveying device and said second media sensor disposed a second distance from said second conveying device, said first distance being different from said second distance such that:

operation of said first and second conveying devices by a first amount advances an associated sheet of media from said first conveying device to said first media sensor; and, operation of said first and second conveying devices by a second amount advances an associated sheet of media from said second conveying device to said second media sensor; and, a control system in communication with at least said marking unit, said conveying device and said media sensor, said control system operative to:

place said printing system in a non-productive condition upon the occurrence of an unexpected event;

determine that said access component has been moved from said second position to said first position while said printing system is in said non-productive condition;

determine which one of said first and second amounts that said first and second conveying devices should be operated;

advance an associated sheet of media at least approximately said determined one of said first and second amounts using at least one of said first and second conveying devices while said printing system is in said non-productive condition;

determine whether one of said first and second media sensors is sensing an associated sheet of media while said printing system is in said non-productive condition; and, if one of said first and second media sensors senses an associated sheet of media, said control system operative to communicate to an associated user that the associated sheet of media within said media transport pathway; and, of said first and second media sensors do not sense an associated sheet of media, said control system operative to initiate returning said printing system to a productive condition.

10. A printing system according to claim 9, wherein said first and second conveying devices synchronously operated with one another.

11. A printing system according to claim 9, wherein said first and second conveying devices include one of a rotatable drive roller or a rotatable nip, and said control system is capable of generating a rotation of said ones of a rotatable drive roller or said rotatable nip to advance the associated sheet of media at least approximately said determined one of said first and second amounts.

12. A printing system according to claim 11, wherein said control system is capable of determining an angle of rotation of said ones of a rotatable drive roller or said rotatable nip to advance the associated sheet of media at least approximately said determined one of said first and second amounts.

13. A printing system according to claim 9 further comprising an access component position sensor operative to generate a position sensor signal indicative of a position of said access component, and said control system is capable of determining that said access component has moved from said second position to said first position based at least in part on said position sensor signal.

14. A printing system according to claim 9 wherein said control system is operative to identify a location of an associated sheet of media using at least one of said first and second media sensors and communicate said location to an associated user.

15. A printing system according to claim 9, wherein said one of a rotatable drive roller and a rotatable nip of said first and second conveying devices are drivably connected to an electric motor for synchronous operation.

* * * * *